US007933416B2

(12) United States Patent
Kim et al.

(10) Patent No.: US 7,933,416 B2
(45) Date of Patent: Apr. 26, 2011

(54) METHOD AND APPARATUS FOR ENCODING AND DECODING MULTI-CHANNEL SIGNALS

(75) Inventors: Dohyung Kim, Hwaseong-si (KR); Junghoe Kim, Seoul (KR); Shihwa Lee, Seoul (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 1428 days.

(21) Appl. No.: 11/313,995

(22) Filed: Dec. 22, 2005

(65) Prior Publication Data

US 2006/0153392 A1 Jul. 13, 2006

(30) Foreign Application Priority Data

Jan. 13, 2005 (KR) ..... 10-2005-0003191

(51) Int. Cl.
*H04R 5/00* (2006.01)

(52) U.S. Cl. ..... 381/23; 381/17; 381/18; 381/22; 704/501

(58) Field of Classification Search ..... 381/1, 17–18, 381/20–23; 704/200, 500–501, 200.1; 281/1, 281/17–18, 20–23
See application file for complete search history.

(56) References Cited

U.S. PATENT DOCUMENTS 5,812,672 A * 9/1998 Herre et al. ..... 381/2
7,136,491 B2 * 11/2006 Fuchigami et al. ..... 381/23
7,668,317 B2 * 2/2010 Yang et al. ..... 381/22
7,720,230 B2 * 5/2010 Allamanche et al. ..... 381/22
2003/0091194 A1 * 5/2003 Teichmann et al. ..... 381/2

FOREIGN PATENT DOCUMENTS

KR 1996-0003455 8/1995
KR 1997-0011743 7/1997
KR 100174085 3/1998

OTHER PUBLICATIONS

Korean Office Action for corresponding Korean Patent Application No. 10-2005-0003191 dated Jun. 26, 2006.
Fuchs, "Improving Joint Stereo Audio Coding by Adaptive Inter-Channel Prediction", XP000570718, Hannover 1, Germany, Oct. 17, 1993, pp. 39-42 (4 pgs) (in English).
Johnston et al., "Sum-Difference Stereo Transform Coding", XP000357067, AT&T Bell Laboratories; Mar. 23, 1992, pp. 569-572 (4 pgs) (in English).
European Search Report for corresponding European Patent Application No. EP06250119 dated Dec. 28, 2007 (5 pgs) (in English).

* cited by examiner

*Primary Examiner* — Devona E. Faulk
*Assistant Examiner* — Disler Paul
(74) *Attorney, Agent, or Firm* — Staas & Halsey LLP

(57) ABSTRACT

A method of encoding multi-channel signals having two or more channels into a first signal and a second signal, and an apparatus to perform the method, the method including generating the first signal by performing a first operation using a first channel signal in the multi-channel signals; and generating the second signal by performing a second operation using a combination of the first channel signal and a second channel signal in the multi-channel signals.

30 Claims, 4 Drawing Sheets

METHOD AND APPARATUS FOR ENCODING AND DECODING MULTI-CHANNEL SIGNALS

CROSS-REFERENCE TO RELATED APPLICATIONS

This application claims the benefit of Korean Patent Application No. 10-2005-0003191, filed on Jan. 13, 2005, in the Korean Intellectual Property Office, the disclosure of which is incorporated herein by reference.

BACKGROUND OF THE INVENTION

1. Field of the Invention

The present invention relates to a method, and an apparatus to perform the method, of encoding and/or decoding multi-channel signals, and, more particularly, to a method, and an apparatus to perform the method, of encoding multi-channel signals according to the similarity among multi-channel signals, and a decoding method and apparatus therefor.

2. Description of the Related Art

In modern telecommunication technologies, most products and processes are changing from analog to digital technologies. In line with this trend, digital transmission has become essential in a vast majority of audio apparatuses and/or audio transmission. The transmission of digital audio signals is more robust against environment noise than that of conventional analog signals. Thus, transmitted digital audio signals can be reproduced with sound quality as clear as digital audio signals reproduced from a compact disc (CD). However, since the amount of data required to be transmitted has constantly increased, many problems, such as the storage capacity of a medium to store data and transmission lines, have arisen.

Data compression is one technology that can be used to alleviate these problems. In an audio compression received after an original audio signal is compressed and transmitted, the quality of the reproduced audio signal is almost the same as that of the original audio signal. That is, audio compression enables the transmission of a smaller amount of information per time unit while ensuring nearly the same quality level of a reproduced audio signal that is not compressed.

Compared to a mono audio signal, which is provided through one channel, a stereo audio signal, which is a combination of audio signals respectively provided through a plurality of channels, enables listeners to enjoy stereo sound.

However, since the stereo audio signal is a combination of mono audio signals obtained from a plurality of channels, storing or transmission of stereo audio signals is more difficult and expensive than that of mono audio signals. This is because when each channel signal of mono audio signals respectively obtained from a plurality of channels is independently encoded, the amount of data increases by a factor of the number of channels. The amount of data can be reduced by reducing the sampling rate or employing lossy encoding, but the sampling rate directly affects the sound quality, and the lossy encoding may also be a factor for the degradation of sound quality.

Accordingly, a method of encoding and decoding multi-channel signals by effectively removing redundant information among channels without directly affecting the sound quality is needed.

SUMMARY OF THE INVENTION

The present invention provides a method and apparatus by which multi-channel signals are encoded and decoded, and in order to effectively remove redundant information among channels, the multi-channel signals are encoded into a first signal having information regarding one channel signal and a second signal having information regarding two channel signals including the first channel signal according to the similarity between the channel signals.

The present invention also provides a method of decoding the first signal and second signal encoded into multi-channel signals, and an apparatus to perform the method.

Additional aspects and/or advantages of the invention will be set forth in part in the description which follows and, in part, will be apparent from the description, or may be learned by practice of the invention.

According to an aspect of the present invention, there is provided a method of encoding multi-channel signals having two or more channels into a first signal and a second signal, the method including: generating the first signal by performing a first operation using a first channel signal from the multi-channel signals; and generating the second signal by combining the first channel signal and a second channel signal from multi-channel signals.

The first signal may comprise the first channel signal, and the second signal may comprise a difference signal of the first channel signal and the second channel signal.

The first channel signal and the second channel signal may comprise a left channel signal and a right channel signal, respectively. The first signal may comprise the left channel signal or the right channel signal, and the second signal may comprise a difference signal of the left channel signal and the right channel signal.

According to another aspect of the present invention, there is provided a method of encoding multi-channel signals formed with a left channel signal and a right channel signal, the method including: calculating a similarity between the left channel signal and the right channel signal; and encoding the multi-channel signals into a first signal and a second signal in response to the similarity being equal to or greater than a predetermined value, wherein the first signal is calculated using the left channel signal or the right channel signal, and the second signal is calculated using a combination of the left channel signal and the right channel signal.

The first signal may comprise the left channel signal or the right channel signal, and the second signal may comprise a difference signal of the left channel signal and the right channel signal.

The calculating of the similarity may comprise calculating a ratio of a mean power of the left channel signal and a mean power of the right channel signal, or a ratio of a scale factor of the left channel signal and a scale factor of the right channel signal, or a ratio of a masking threshold of the left channel signal and a masking threshold of the right channel signal.

The multi-channel signals may be encoded into the first signal and the second signal in response to the calculated ratio being a value in a predetermined range with respect to 1.

The multi-channel signals may be encoded into a first signal that is a sum signal of the left channel signal and the right channel signal, and a second signal that is a difference signal of the left channel signal and the right channel signal, in response to the similarity being less than a predetermined value.

According to another aspect of the present invention, there is provided a method of decoding a first signal and a second signal into multi-channel signals formed with two or more channels, the method including: decoding a first channel signal among the multi-channel signals by performing a first operation with the first signal; and decoding a second channel signal among the multi-channel signals by performing a second operation with a combination of the first signal and the second signal.

The first channel signal may comprise the first signal.

The first channel signal and the second channel signal may comprise a left channel signal and a right channel signal, respectively, and the left channel signal or the right channel signal may be the first signal.

According to another aspect of the present invention, there is provided an apparatus to encode multi-channel signals formed with a left channel signal and a right channel signal, including: a similarity calculation unit to calculate a similarity between the left channel signal and the right channel signal; and an encoder to encode the multi-channel signals into a first signal and a second signal in response to the similarity being equal to or greater than a predetermined value; wherein the encoder generates the first signal by performing a first operation with the left channel signal or the right channel signal, and generates the second signal by performing a second operation with a combination of the left channel signal and the right channel signal.

The first signal may comprise the left channel signal or the right channel signal. The second signal may be generated by performing a differential operation of the left channel signal and the right channel signal.

The similarity calculation unit may calculate a ratio of a mean power of the left channel signal and a mean power of the right channel signal, or a ratio of a scale factor of the left channel signal and a scale factor of the right channel signal, or a ratio of a masking threshold of the left channel signal and a masking threshold of the right channel signal.

The encoder may encode the multi-channel signals into the first signal and the second signal in response to the calculated ratio being a value in a predetermined range with respect to 1.

The methods of encoding and decoding multi-channel signals may be implemented as computer programs on a computer readable recording medium.

According to a another aspect of the present invention, there is provided an apparatus to decode a first signal and a second signal into multi-channel signals formed with two or more channels, including: a first decoding unit to receive the first signal and decode a first channel signal among the multi-channel signals by performing a first operation with the first signal; and a second decoding unit to receive the first signal and the second signal and decode a second channel signal among the multi-channel signals by performing a second operation with a combination of the first signal and the second signal.

The first channel signal may comprise the first signal. The first channel signal and the second channel signal may comprise a left channel signal and a right channel signal, respectively.

The left channel signal or the right channel signal may comprise the first signal.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE PREFERRED EMBODIMENTS

Figure 1:
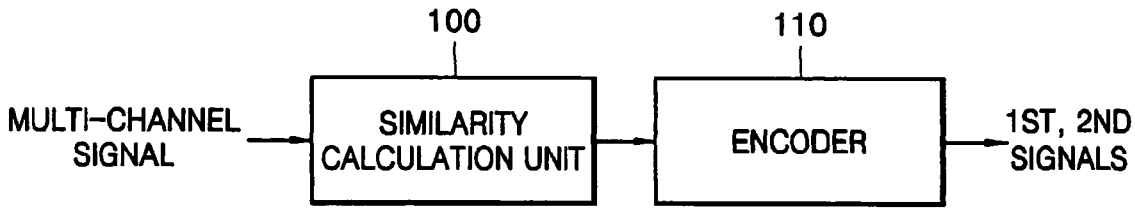
FIG. 1 is a block diagram illustrating the structure of an apparatus to encode multi-channel signals according to an embodiment of the present invention.

Reference will now be made in detail to the embodiments of the present invention, examples of which are illustrated in the accompanying drawings, wherein like reference numerals refer to the like elements throughout. The embodiments are described below to explain the present invention by referring to the figures.

Figure 8:
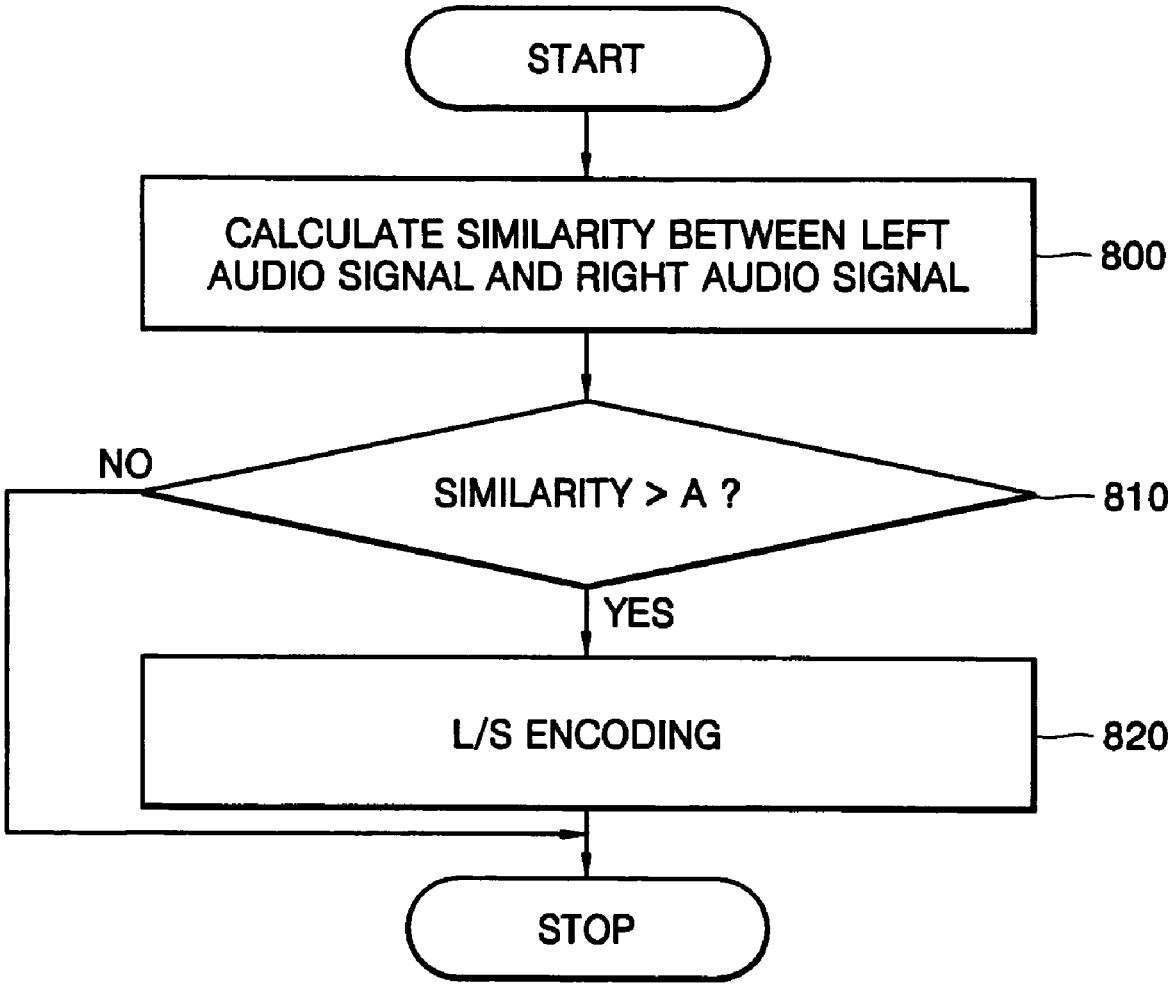
FIG. 8 is a flowchart illustrating the operations of a method of encoding multi-channel signals according to an embodiment of the present invention.

Referring to FIG. 1, an apparatus to encode multi-channel signals according to an embodiment of the present invention includes a similarity calculation unit 100 and an encoder 110. The operation of the encoding apparatus shown in FIG. 1 will now be explained with reference to the flowchart illustrating an encoding method shown in FIG. 8.

The similarity calculation unit 100 calculates the similarity between a left audio signal and a right audio signal of a stereo signal in operation 800. Preferably, though not necessarily, the left audio signal and the right audio signal are divided into a preset number of frequency bands, and the similarity calculation unit 100 calculates the similarity between the left audio signal and the right audio signal in each of the respective divided frequency bands.

Preferably, though not necessarily, the similarity between the left audio signal and the right audio signal is calculated as the ratio of the mean powers, or the ratio of scale factors, or the ratio of masking threshold values of the two audio signals. The mean power is the mean power of samples included in each respective frequency band of an audio signal. The scale factor is a value having a representative characteristic in each respective frequency band. As a method to calculate the scale factor, preferably, though not necessarily, a value of a sample having the largest absolute value among samples included in each respective frequency band is obtained.

The masking threshold value is the maximum size of a signal that a human being cannot perceive due to interactions of audio signals. The masking threshold value relates to a masking phenomenon occurring when a signal masks another signal by mutual interference of audio signals in a psychoacoustic model, which is normally used to encode an audio signal, and thusly a human being cannot perceive the masked signal. Preferably, though not necessarily, the masking threshold value is obtained in each respective frequency band.

As the calculated ratio of the mean powers, the scale factors, or the masking threshold values of the left audio signal and the right audio signal approaches a value of 1, the similarity between the two channels is higher.

The similarity calculation unit 100 determines whether or not the calculated similarity is equal to or greater than a predetermined similarity (A), and if it is equal to or greater than (A), generates and outputs a signal so that the encoder 110 performs Left/Side (L/S) encoding of the stereo signals in operation 810. Preferably, though not necessarily, in a case in which the calculated ratio of the mean powers, the scale factors, or the masking threshold values of the left audio signal and the right audio signal is included in a predetermined range with respect to 1, the encoder 110 performs encoding. For example, in the case in which the value of the calculated ratio is in a range of ±0.1 with respect to 1, that is, the calculated ratio is included in a range from 0.9 to 1.1, the encoder 110 performs encoding.

The encoder 110 receives the signal input indicating to perform encoding from the similarity calculation unit 100, performs L/S encoding of the left audio signal and the right audio signal, and outputs a first signal and a second signal in operation 820.

Figure 2:
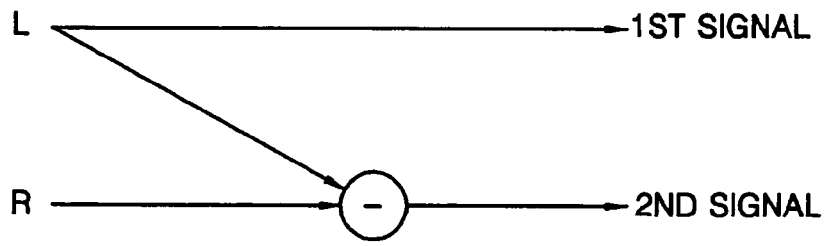
FIG. 2 illustrates a Left/Side (L/S) encoding method.

FIG. 2 illustrates an embodiment of the L/S encoding method, and the left audio signal (L) and the right audio signal (R) can be encoded into a first signal and a second signal by using equation 1:

$$\begin{bmatrix} \text{first signal} \\ \text{second signal} \end{bmatrix} = \begin{bmatrix} x & 0 \\ y & z \end{bmatrix} \begin{bmatrix} L \\ R \end{bmatrix} \tag{1}$$

In equation 1, x, y, and z are constant numbers. According to equation 1, the first signal is calculated by using only the left audio signal (L), and includes information regarding only the left audio signal, and the second signal is calculated as a combination of the left audio signal (L) and the right audio signal (R), and includes information regarding the left signal (L) and the right audio signal (R). More specifically, preferably, though not necessarily, the stereo signals may be encoded into the first signal and the second signal according to the following equation 2:

$$\begin{bmatrix} \text{first signal} \\ \text{second signal} \end{bmatrix} = \begin{bmatrix} 1 & 0 \\ 0.5 & -0.5 \end{bmatrix} \begin{bmatrix} L \\ R \end{bmatrix} \tag{2}$$

According to equation 2, the first signal encoded by the L/S encoder 110 is the same as the left audio signal (L), and the second signal is obtained by dividing the difference signal of the left signal (L) and the right signal (R) by 2.

Figure 3:
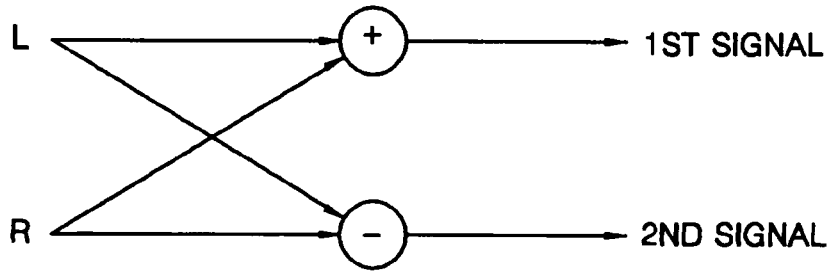
FIG. 3 illustrates a Mid/Side (M/S) encoding method.

When the similarity of the left signal (L) and the right signal (R) is equal to or less than the predetermined value (A), that is, in a case in which it is determined that the two signals are not similar, preferably, though not necessarily, the two signals are not encoded, and quantization is performed for each channel, or Mid/Side (M/S) encoding is performed. FIG. 3 illustrates the M/S encoding method. In the M/S encoding, the left signal (L) and the right signal (R) can be encoded into a first signal and a second signal according to the following equation 3:

$$\begin{bmatrix} \text{first signal} \\ \text{second signal} \end{bmatrix} = \begin{bmatrix} 1 & 1 \\ 1 & -1 \end{bmatrix} \begin{bmatrix} L \\ R \end{bmatrix} \tag{3}$$

According to equation 3, in the M/S encoding, the sum signal and the difference signal of the left signal (L) and the right signal (R) are generated such that the stereo signals are encoded.

Figure 4:
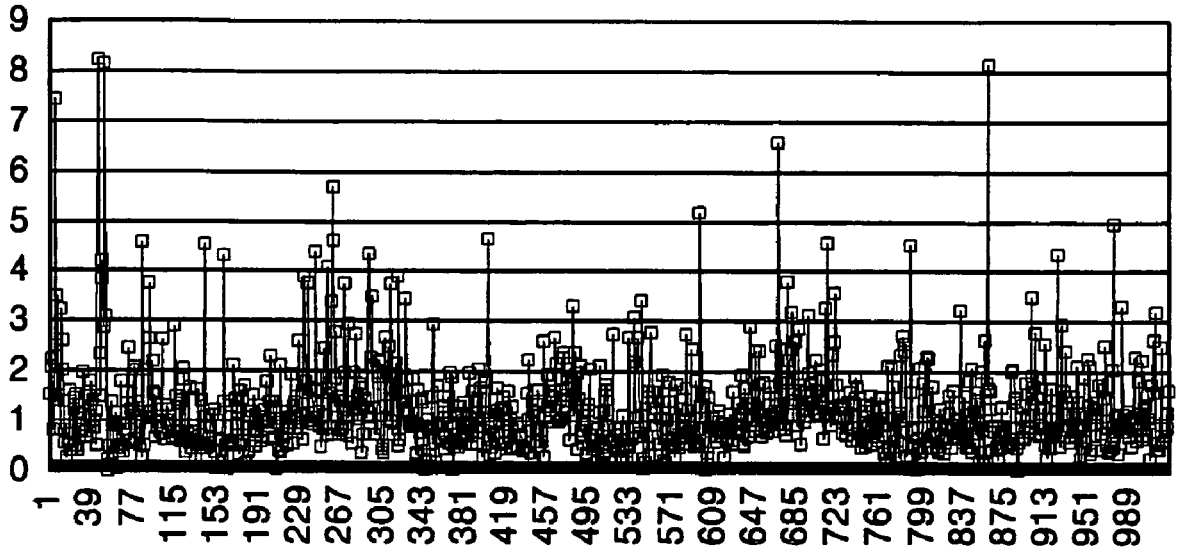
FIG. 4 is a graph illustrating an embodiment of the ratio of mean powers between a left audio signal and a right audio signal.

FIG. 4 is a graph illustrating an embodiment of the ratio of mean powers between a left audio signal and a right audio signal. Since the ratios of the mean powers between the two channels, illustrated in FIG. 4, include values close to 0 and 8, which are distant from 1, it can be seen that the similarity between the left audio signal and the right audio signal is low. Accordingly, because the illustrated stereo signals include such dissimilar stereo components, it is preferable, though not necessary, that each channel of the left audio signal and the right audio signal is quantized.

Figure 5:
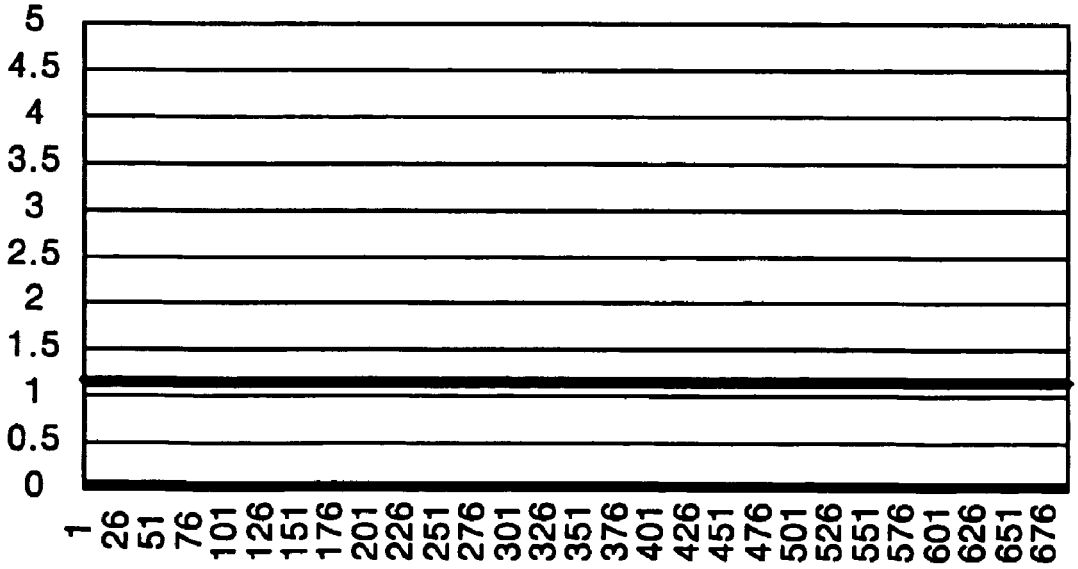
FIG. 5 is a graph illustrating another embodiment of the ratio of mean powers between a left audio signal and a right audio signal.

FIG. 5 is a graph illustrating another embodiment of the ratio of mean powers between a left audio signal and a right audio signal. Since the ratios of the mean powers between the two channels, illustrated in FIG. 5, include values that are very close to 1, it can be seen that the similarity between the left audio signal and the right audio signal is high. Accordingly, because the shown stereo signals include such similar components that they are similar to mono components, it is preferable, though not necessary, that the left audio signal and the right audio signal are encoded into a first signal and a second signal according to the L/S encoding method described above in order to remove redundant components, and then quantized.

Figure 6:
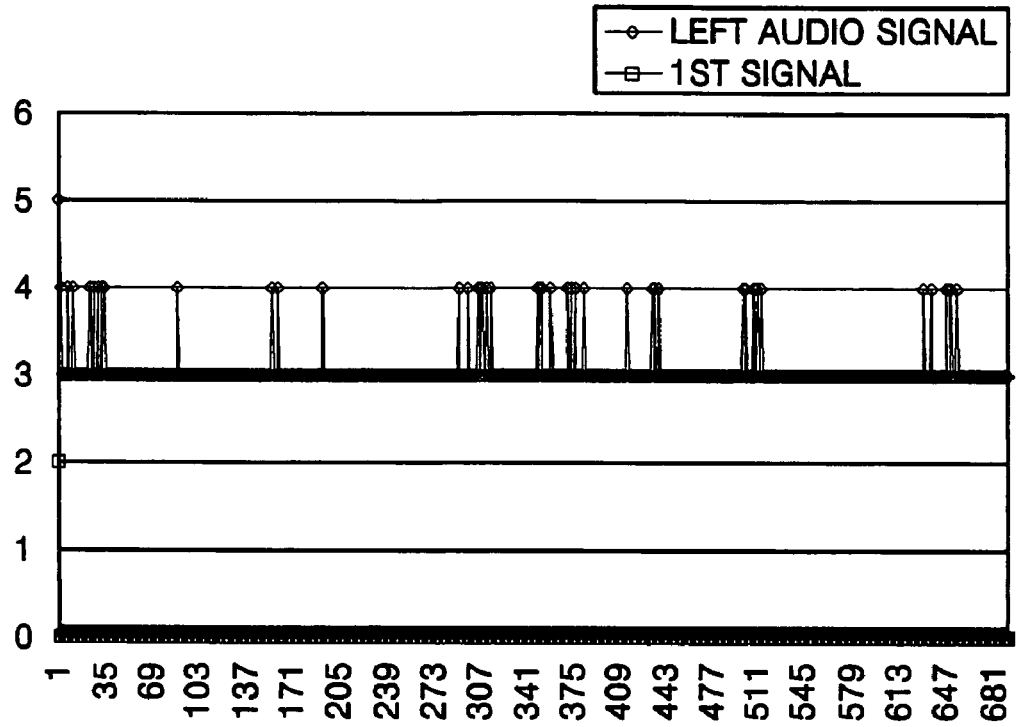
FIG. 6 is a graph illustrating distribution changes of a left audio signal and a first signal according to Left/Side (L/S) encoding.

FIG. 6 is a graph illustrating distribution changes of a left audio signal and a first signal according to the L/S encoding, and illustrates the obtained SR_Index of the first signal and the left audio signal relative to one frequency band. The bigger the obtained SR_Index is, the less weight a signal included in the corresponding frequency band has in the entire signal. Accordingly, it can be seen that in the case in which the left audio signal is L/S encoded into a first signal, the weight of the corresponding frequency band increases.

Figure 7:
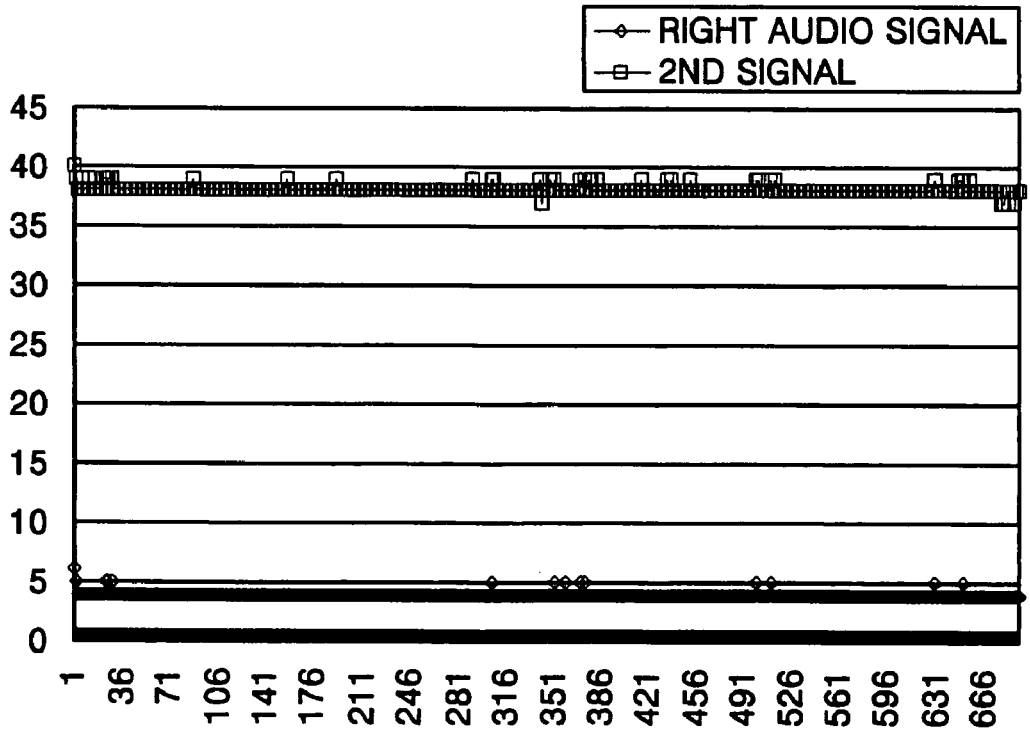
FIG. 7 is a graph illustrating distribution changes of a right audio signal and a second signal according to the L/S encoding.

FIG. 7 is a graph illustrating distribution changes of a right audio signal and a second signal according to the L/S encoding, and illustrates the obtained SR_Index of the second signal and the right audio signal relative to one frequency band. According to the graph, it can be seen that in the case in which the combination of the right audio signal and the left audio signal is L/S encoded into a second signal, the weight of the frequency band of the second signal is reduced much more than that of the right audio signal.

According to FIGS. 6 and 7, in the case in which the similarity of the left audio signal and the right audio signal is high, by performing L/S encoding, redundant information between channels is removed such that the number of bits for the signal can be reduced.

A method of decoding multi-channel signals encoded by the encoding method described above will now be explained. The stereo signals encoded by using equation 1 can be decoded into the left audio signal (L) and the right audio signal (R) by using equation 4:

$$\begin{bmatrix} L \\ R \end{bmatrix} = \frac{1}{xz} \begin{bmatrix} z & 0 \\ -y & x \end{bmatrix} \begin{bmatrix} \text{first signal} \\ \text{second signal} \end{bmatrix} \tag{4}$$

The stereo signals encoded by using equation 2 can be decoded into the left audio signal (L) and the right audio signal (R) by using equation 5:

$$\begin{bmatrix} L \\ R \end{bmatrix} = \begin{bmatrix} 1 & 0 \\ 1 & -2 \end{bmatrix} \begin{bmatrix} \text{first signal} \\ \text{second signal} \end{bmatrix} \tag{5}$$

The stereo signals encoded by using equation 3 can be decoded into the left audio signal (L) and the right audio signal (R) by using equation 6:

$$\begin{bmatrix} L \\ R \end{bmatrix} = \begin{bmatrix} 0.5 & 0.5 \\ 0.5 & -0.5 \end{bmatrix} \begin{bmatrix} \text{first signal} \\ \text{second signal} \end{bmatrix} \quad (6)$$

Though the method of encoding stereo signals formed with the left audio signal and the right audio signal is explained above, the present invention can also be applied to multi-channel signals from three or more channels. In the case in which multi-channel signals having 3 or more channels are encoded, it is preferable, though not necessary, that the signals are encoded into a first signal having information regarding only a first channel signal preset among the multi-channel signals, and a second signal having information regarding the first channel signal and a second channel signal preset among the signals.

Also, though the methods of encoding and/or decoding multi-channel audio signals are explained above, the present invention can also be applied to a method of encoding and/or decoding multi-channel video signals.

In addition to the above-described embodiments, the method of the present invention can also be implemented by executing computer readable code/instructions in/on a medium, e.g., a computer readable medium. The medium can correspond to any medium/media permitting the storing and/or transmission of the computer readable code. The code/instructions may form a computer program.

The computer readable code/instructions can be recorded/transferred on a medium in a variety of ways, with examples of the medium including magnetic storage media (e.g., ROM, floppy disks, hard disks, etc.) and optical recording media (e.g., CD-ROMs, or DVDs). The computer readable code/instructions may be executed by one or more processors.

According to the method, and apparatus to perform the method, of encoding and/or decoding multi-channel signals as described above, when multi-channel signals are encoded, by encoding the multi-channel signals according to the similarity between a right channel signal and a left channel signal, redundant information between channels can be removed, and the signal can be encoded with less bits.

Although a few embodiments of the present invention have been shown and described, it would be appreciated by those skilled in the art that changes may be made in these embodiments without departing from the principles and spirit of the invention, the scope of which is defined in the claims and their equivalents.

What is claimed is:

1. A method of encoding multi-channel signals formed with a left channel signal and a right channel signal, the method comprising:

using a processor to perform:

calculating a similarity between the left channel signal and the right channel signal; and encoding the multi-channel signals into a first signal and a second signal in response to the similarity;

wherein, if the similarity is equal to or greater than a predetermined value, the first signal is calculated using one of the left channel signal or the right channel signal, and the second signal is calculated using a combination of the left channel signal and the right channel signal, wherein, if the similarity is less than a predetermined value, the first signal is a sum signal of the left channel signal and the right channel signal, and the second signal is a difference signal of the left channel signal and the right channel signal.

2. The method of claim 1, wherein, if the similarity is equal to or greater than a predetermined value, the first signal comprises only the left channel signal or only the right channel signal.

3. The method of claim 1, wherein, if the similarity is equal to or greater than a predetermined value, the second signal comprises a difference signal of the left channel signal and the right channel signal.

4. The method of claim 1, wherein the calculating of the similarity comprises calculating a ratio of a mean power of the left channel signal and a mean power of the right channel signal.

5. The method of claim 4, wherein, if the similarity is equal to or greater than predetermined value, the multi-channel signals are encoded into the first signal and the second signal in response to the calculated ratio being a value in a predetermined range with respect to 1.

6. The method of claim 1, wherein the calculating of the similarity comprises calculating a ratio of a scale factor of the left channel signal and a scale factor of the right channel signal.

7. The method of claim 6, wherein, if the similarity is equal to or greater than a predetermined value, the multi-channel signals are encoded into the first signal and the second signal in response to the calculated ratio being a value in a predetermined range with respect to 1.

8. The method of claim 1, wherein the calculating of the similarity comprises calculating a ratio of a masking threshold of the left channel signal and a masking threshold of the right channel signal.

9. The method of claim 8, wherein, if the similarity is equal to or greater than a predetermined value, the multi-channel signals are encoded into the first signal and the second signal in response to the calculated ratio being a value in a predetermined range with respect to 1.

10. A method of decoding a first signal and a second signal into multi-channel signals formed with two or more channels, the method comprising:

using a processor to perform:

decoding a first channel signal among the multi-channel signals by performing a first operation with the first signal; and decoding a second channel signal among the multi-channel signals by performing a second operation with a combination of the first signal and the second signal, wherein the first signal is encoded using only the first channel signal and the second signal is encoded using a combination of the first channel signal and the second channel signal, if a similarity between the first channel signal and the second channel signal is equal to or greater than a predetermined value.

11. The method of claim 10, wherein the first channel signal comprises only the first signal.

12. The method of claim 10, wherein the first channel signal and the second channel signal comprise a left channel signal and a right channel signal, respectively.

13. The method of claim 12, wherein the left channel signal or the right channel signal comprises the first signal.

14. At least one non-transitory computer readable medium storing instructions that control at least one processor to perform a method of encoding multi-channel signals formed with a left channel signal and a right channel signal, the method comprising:

calculating a similarity between the left channel signal and the right channel signal; and encoding the multi-channel signals into a first signal and a second signal in response to the similarity;

wherein, if the similarity is equal to or greater than a predetermined value, the first signal is calculated using one of the left channel signal or the right channel signal, and the second signal is calculated using a combination of the left channel signal and the right channel signal, wherein, if the similarity is less than a predetermined value, the first signal is a sum signal of the left channel signal and the right channel signal, and the second signal is a difference signal of the left channel signal and the right channel signal.

15. At least one non-transitory computer readable medium storing instructions that control at least one processor to perform a method of decoding a first signal and a second signal into multi-channel signals formed with two or more channels, the method comprising:

decoding a first channel signal among the multi-channel signals with the first signal from among a plurality of channel signals in the multi-channel signals; and decoding a second channel signal among the multi-channel signals by performing a second operation with a combination of the first signal and the second signal, wherein the first signal is encoded using only the first channel signal and the second signal is encoded using a combination of the first channel signal and the second channel signal, if a similarity between the first channel signal and the second channel signal is equal to or greater than a predetermined value.

16. An apparatus to encode multi-channel signals formed with a left channel signal and a right channel signal, comprising:

a similarity calculation unit to calculate a similarity between the left channel signal and the right channel signal; and an encoder, controlled by a processor, to encode the multi-channel signals into a first signal and a second signal in response to the similarity;

wherein, if the similarity equal to or greater than a predetermined value, the encoder generates the first signal with one of the left channel signal or the right channel signal, and generates the second signal by performing a second operation with a combination of the left channel signal and the right channel signal, wherein, if the similarity is less than a predetermined value, the first signal is a sum signal of the left channel signal and the right channel signal, and the second signal is a difference signal of the left channel signal and the right channel signal.

17. The apparatus of claim 16, wherein, if the similarity is equal to or greater than a predetermined value, the first signal comprises only the left channel signal or only the right channel signal.

18. The apparatus of claim 16, wherein, if the similarity is equal to or greater than a predetermined value, the second signal is generated by performing a differential operation of the left channel signal and the right channel signal.

19. The apparatus of claim 16, wherein the similarity calculation unit calculates a ratio of a mean power of the left channel signal and a mean power of the right channel signal.

20. The apparatus of claim 19, wherein, if the similarity is equal to or greater than a predetermined value, the encoder encodes the multi-channel signals into the first signal and the second signal in response to the calculated ratio being a value in a predetermined range with respect to 1.

21. The apparatus of claim 16, wherein the similarity calculation unit calculates a ratio of a scale factor of the left channel signal and a scale factor of the right channel signal.

22. The apparatus of claim 21, wherein, if the similarity is equal to or greater than a predetermined value, the encoder encodes the multi-channel signals into the first signal and the second signal in response to the calculated ratio being a value in a predetermined range with respect to 1.

23. The apparatus of claim 16, wherein the similarity calculation unit calculates a ratio of a masking threshold of the left channel signal and a masking threshold of the right channel signal.

24. The apparatus of claim 23, wherein, if the similarity is equal to or greater than a predetermined value, the encoder encodes the multi-channel signals into the first signal and the second signal in response to the calculated ratio being a value in a predetermined range with respect to 1.

25. An apparatus to decode a first signal and a second signal into multi-channel signals formed with two or more channels, comprising:

a first decoding unit, controlled by a processor, to receive the first signal and decode a first channel signal among the multi-channel signals by performing a first operation with the first signal; and a second decoding unit to receive the first signal and the second signal and decode a second channel signal among the multi-channel signals by performing a second operation with a combination of the first signal and the second signal, wherein the first signal is encoded using only the first channel signal and the second signal is encoded using a combination of the first channel signal and the second channel signal, if a similarity between the first channel signal and the second channel signal is equal to or greater than a predetermined value.

26. The apparatus of claim 25, wherein the first channel signal comprises only the first signal.

27. The apparatus of claim 25, wherein the first channel signal and the second channel signal comprise a left channel signal and a right channel signal, respectively.

28. The apparatus of claim 27, wherein the left channel signal or the right channel signal comprises the first signal.

29. A method of encoding multi-channel signals formed with a left channel signal and a right channel signal, the method comprising:

using a processor to perform:

determining a similarity between the left and right channel signals; and encoding the multi-channel signals into a first signal and a second signal in response to the similarity being equal to or greater than a predetermined value, wherein the first signal comprises only the left channel signal or only the right channel signal, wherein the second signal comprises a combination of the left and right channel signals.

30. The method of claim 29, wherein the multi-channel signals comprise audio and/or video signals.

* * * * *